United States Patent [19]

Schwarzkopf

[11] Patent Number: 4,617,455

[45] Date of Patent: Oct. 14, 1986

[54] ELECTRICAL HEATING CARTRIDGE

[75] Inventor: Eugen Schwarzkopf, Lüdenscheid, Fed. Rep. of Germany

[73] Assignee: Hotset Heizpatronen und Zubehor GmbH, Lüdenscheid, Fed. Rep. of Germany

[21] Appl. No.: 774,462

[22] Filed: Sep. 10, 1985

[30] Foreign Application Priority Data

Nov. 28, 1984 [DE] Fed. Rep. of Germany ..... 3443306

[51] Int. Cl.[4] ..... H05B 3/06; H01C 1/028

[52] U.S. Cl. ..... 219/523; 219/544; 338/239

[58] Field of Search ..... 219/544, 523, 494; 338/238, 239, 260, 261, 262, 273

[56] References Cited

U.S. PATENT DOCUMENTS 1,394,518 10/1921 Abbott ..... 338/239
3,890,485 6/1975 Kozbelt ..... 219/523
3,920,963 11/1975 Beasley et al. ..... 219/544 X

FOREIGN PATENT DOCUMENTS 7932598 2/1980 Fed. Rep. of Germany .

*Primary Examiner*—L. T. Hix
*Assistant Examiner*—Douglas S. Lee
*Attorney, Agent, or Firm*—Karl F. Ross; Herbert Dubno

[57] ABSTRACT

An electrical heating cartridge comprises a jacket, preferably of metal, at least one electrical heating coil and a thermocouple element positioned in the jacket which are imbedded with clearance from each other and from the jacket in a specially packed insulating material, wherein the electrical lead conductors of each of the electrical heating coils and the thermocouple element are guided out of a first end piece of the electrical heating cartridge. So that a rapid, controlled, uniform heating of the entire length of the cartridge is attainable, at least one electrical heating coil is directed toward a second end piece opposite to the first end piece of the cartridge and extended over and beyond the thermocouple element until adjacent the second end piece.

6 Claims, 3 Drawing Figures

ELECTRICAL HEATING CARTRIDGE

FIELD OF THE INVENTION

My present invention relates to electrical-heating cartridges and the like for the electrical heating of a body with which they are in intimate contact, for example by insertion therein.

BACKGROUND OF THE INVENTION

Electrical heating cartridges can comprise at least one electrical heating coil and a thermocouple element mounted inside a jacket, preferably of metal such cartridges can be used for heating electrical switch boxes, articles in which they are inserted, etc.

The electrical heating coil or coils and thermocouple element are imbedded in a packed insulating material with clearance from each other and from the preferably metal jacket. The electrical lead conductors of the electrical heating coils and of the thermocouple element are fed out of one end of the heating cartridge, the heating coil has a first strand beginning at a first end piece and being fed toward a second end piece of the closed end of the electrical heating cartridge opposite to the first end piece and a second strand connected to the first strand and guided back to the first end piece. Advantageously the thermocouple element is oriented substantially parallel to the electrical heating coil.

In the known electrical heating cartridges, as taught in German utility model DE-GM No. 79 32 598, the position of attachment of the thermocouple legs oriented at an acute angle to each other at the measuring point is on the metal base of the jacket which closes the cartridge at the closed or bottom end and the electrical heating coil has a comparatively large clearance from the aforementioned base being set back therefrom.

Because of this arrangement relatively large regions of the cartridge may not be directly heated.

The measuring point of the thermocouple element is positioned with a comparatively large clearance from the electrical heating coil, so that the heating effect of the electrical heating coil can be determined by the thermocouple element only with a significant time delay.

Consequently the cartridge in the vicinity of the heating coil may have already exceeded the desired preselected maximum temperature before the thermocouple element and the control mechanism influenced by it can react.

OBJECTS OF THE INVENTION

The aim of my invention is to improve an electrical heating cartridge of the foregoing kind, so that a more uniform heating over the entire length of the cartridge is attained, which results in faster and more precise thermal control of the electrical heating cartridge.

It is an object of my invention to provide an improved electrical heating cartridge.

It is also an object of my invention to provide an improved electrical heating cartridge which is heated more uniformly than those of the prior art.

It is another object of my invention to provide an improved electrical heating cartridge whose controlled heat up is faster than those of the prior art.

It is a further object of my invention to provide an electrical heating cartridge which is more uniformly heated with a faster, more accurate thermal control mechanism than the previously known electrical heating cartridges.

SUMMARY OF THE INVENTION

These objects and others which will become apparent hereinafter are attained in accordance with my invention in an electrical heating cartridge comprising at least one electrical heating coil and a thermocouple element mounted inside a jacket, preferably of metal, the electrical heating coils and thermocouple element being imbedded in a packed insulating material with clearance from each other and from the metal jacket.

The electrical lead conductors of each of the electrical heating coils and of the thermocouple element are guided out of a first end piece of the heated cartridge. Each of the electrical heating coils has a first strand beginning at the first end piece and being fed toward a second end piece on the end of the electrical heating cartridge opposite to that of the first end piece and a second strand connected to the first strand and guided back to the first end piece. Advantageously the thermocouple element is oriented substantially parallel to the electrical heating coil.

According to my invention at least one electrical heating coil is directed toward the second end piece and extended over and beyond the thermocouple element until adjacent the second end piece. The closed bottom of the metal shell and the coil lies thus between the bottom and the thermocouple.

Thus the electrical heating coil can be positioned with equal clearance from the metal jacket and also from the second end piece positioned opposite to the end of the cartridge through which the conductors are input, as a result of which the sought after uniform heat up of the cartridge is made possible.

Moreover the connection point of the legs of the thermocouple now is positoned directly in the vicinity of the region of the cartridge heated by the electrical heating coil, whereby heating control without any delay is guaranteed.

Further according to a preferred embodiment of my invention the thermocouple element is positioned between the strand of one of the electrical heating coils and is oriented in the same plane as the electrical heating coil or one of these coils.

Furthermore in an embodiment in which the jacket of the cartridge has an oval cross section, the strands of one of the electrical heating coils may be advantageously positioned substantially in the longitudinal plane of the jacket in which the largest diameter of that oval-shaped cross section lies, i.e. the major-diameter cross section. This has the advantage that also the electrical heating cartridge in contrast to the cartridge with the circular shaped cross section, can be inserted in a hole in the body to be heated which fits the diameter of the cartridge, and a large surface contact of the jacket surface of the cartridge to the body to be heated can be attained, so that especially intensive heat conduction from the electrical heating cartridge to the heated body can result, which the electrical heating coil in spite of the comparatively small space alloted to the cartridge can be made comparatively large, without precluding installation of a thermocouple element.

In a further particular preferred embodiment of my invention in harmony with the aims of my invention the legs of the thermocouple element are connected (in line) to each other and are at least oriented linearly in a straight part of the electrical heating cartridge in the vicinity of the connecting position at which the legs are joined, the connection or junction position also functioning as the point at which temperature is measured. The junction and its legs lie in line with one of the straight thermocouple leads.

In this way it is possible to position the measuring point of the thermocouple element in any region or part of the length of the cartridge, and therefore of the body to be heated, so that it reacts most sensitively to any excess heating.

According to another feature of my invention one of the legs of the thermocouple element or the one of the equalizing conductors or lead conductors attached to that leg, connected in the electrical heating cartridge adjacent the second end piece is bent substantially 180° around an insulating body and is mounted in the electrical heating cartridge so as to be adjustably positionable lengthwise therein. This has the advantage that the position of the measuring point in the heated cartridge, also according to the structure of the thermostat, can be selected corresponding to the requirements partially described above and also can be adjusted.

In electrical heating cartridges with packed insulating material it is required, to be sure, that the positioning of the measuring point of the thermocouple element be performed before packing of the insulating material.

The electrical heating cartridge can have two electrical heating coils, and the strands of these two electrical heating coils are positioned circumferentially staggered substantially 90° to each other.

BRIEF DESCRIPTION OF THE DRAWING

The above and other objects, features and advantages of my invention will become more readily apparent from the description, reference being made to the accompanying diagrammatic drawing in which.

SPECIFIC DESCRIPTION

Figure 1:
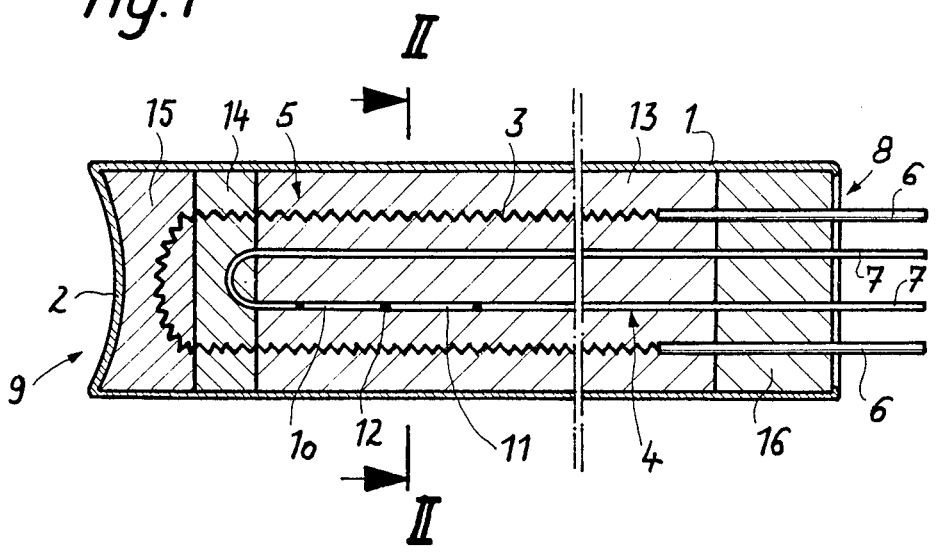
FIG. 1 is a longitudinal cross sectional view of a preferred embodiment of the electrical heating cartridge according to my invention.
Figure 2:
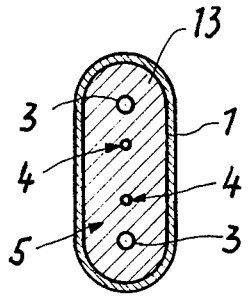
FIG. 2 is a cross sectional view of the device of FIG. 1 taken along the section line II—II thereof.

The electrical heating cartridge shown in FIGS. 1 and 2 comprises a metallic jacket 1, which is closed at one end by a base 2, likewise of metal, particularly stainless steel, an electrical heating coil 3, a thermocouple element 4, and a packing of insulating material 5.

The electrical lead conductors 6 and 7 of the electrical heating coil 3 and the thermocouple element 4 are fed out of a first end piece 8 on the end of the cartridge opposite to that of the base 2.

The electrical heating coil 3 has a first strand extended from the first end piece 8 and guided toward a second end piece 9 opposite to the first end piece 8 and a second strand guided back from the second end piece 9 to the first end piece 8. Furthermore the electrical heating coil 3 extends until it is comparatively near to the base 2 of the second end piece 9. The clearance of the electrical heating coil 3 from the base 2 corresponds approximate to the clearance of the electrical heating coil 3 from the jacket 1 and must preclude an electrical contact between the electrical heating coil 3 and the jacket 1 and/or the base 2.

According to FIGS. 1 and 2 the jacket 1 has an oval-shaped cross section and the thermocouple element 4 is positioned between the first and second strands of the electrical heating coil 3 and oriented in the plane of those strands. Furthermore the plane of the strands of the electrical heating coil 3 and the thermocouple element 4 lies with the largest diameter of the cross section of the jacket 1 in it.

The legs 10 and 11 of the thermocouple element 4 are coaxially connected directly with each other rigidly and are oriented so as to run parallel to the leads of the electrical heating coil 3 in line with one of the thermocouple leads.

The connection point of the legs 10 and 11 or the measuring point 12 of the thermocouple element 4 is provided in the vicinity of the extended strands of the electrical heating coil 3 and no longer as in the prior art in the vicinity of the returning bend in the electrical heating coil 3 adjacent the second end piece 9.

To the legs 10 and 11 of the thermocouple element 4 electrical lead conductors 7 formed as equalizing conductors are connected. The electrical heating coil 3 and the thermocouple element 4 are held in originally rigid insulating bodies 13 and 14 which are held by each other and also jacket 1 in the correct position, wherein in the insulating bodies 13 and 14, which are subsequently smashed and packed, four channels running with their axes parallel are positioned, through which the first and second strands of the electrical heating coil 3 and the legs 10 and 11 of the thermocouple element 4 are fed through, as is apparent from FIG. 1.

One of the bendable conductors 7 is bent back approximately 180° around the end of the insulating body 13 closest to the second end piece 9, so that by drawing or pulling on one or the other equalizing conductor 7 the measuring point or connection point 12 of the thermocouple element 4 can be moved continuously relative to the electrical heating coil 3.

A granular or powdered insulating body 15 is provided adjacent the base 2, which is likewise packed in the diminishing cross section of the electrical heating cartridge.

The originally open first end piece 8 of the jacket 1 is closed in a known way with packing 16 therein.

Figure 3:
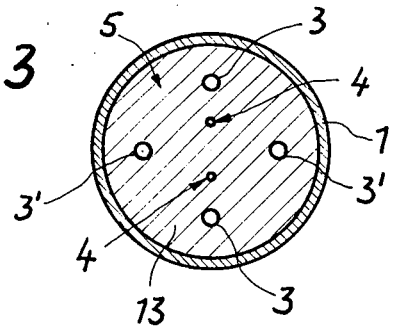
FIG. 3 is a cross sectional view similar to FIG. 2 of another preferred embodiment of the electrical heating cartridge according to my invention.

According to a different preferred embodiment indicated in FIG. 3 a cross section of the jacket and cartridge is circular instead of oval as in FIG. 2 and two electrical heating coils 3 and 3' are inserted, whose strands are positioned circumferentially staggered approximately 90° to each other. The thermocouple element 4 is positioned so as to run in the plane of the electrical heating coil 3'.

When the insulating material 5 is not yet packed in the cartridge and thus is in its original rigid form, the measuring point 12 is adjustable at any time.

I claim:

1. In an electrical heating cartridge comprising a jacket in which at least one electrical heating coil and a thermocouple element are positioned, said electrical heating coil and said thermocouple element being imbedded in a packed insulating material with clearance from each other and from said jacket in said electrical heating cartridge, wherein the electrical lead conductors of said electrical heating coil and of said thermocouple element are fed out of a first end piece of said electrical heating cartridge, wherein further said electrical heating coils has a first strand beginning at said first end piece and being guided toward a second end piece on the end of said electrical heating cartridge opposite to said first end piece and a second strand connected to said first strand and guided back to said first end piece, the improvement wherein said electrical heating coils is directed toward said second end piece and extended over and beyond said thermocouple element until adjacent said end piece.

2. The improvement defined in claim 1 wherein said jacket is formed from metal and wherein said thermocouple element is oriented substantially parallel to said electrical heating coil, and said thermocouple element is positioned between said strands of said electrical heating coil and is oriented in the same plane as said electrical heating coil.

3. The improvement defined in claim 2 wherein said jacket has an oval-shaped cross section, and said strands of said one of said electrical heating coils are positioned substantially in the longitudinal plane of said jacket in which the largest diameter of said oval shaped cross section of said jacket lies.

4. The improvement defined in claim 3, wherein said legs of said thermocouple element are connected directly coaxially to each other and are at least oriented in the same direction with respect to the longitudinal extent of said electrical heating cartridge in the vicinity of a junction at which said legs are joined to each other, said junction forming a measuring point at which the temperature is measured.

5. The improvement defined in claim 4 wherein the one of said legs of said thermocouple element connected to one of said electrical lead conductors formed as an equalizing conductor closest to said second end piece is returned to said first end piece by bending substantially 180° around an insulating body formed from said insulating material and said one of said legs of said thermocouple element is mounted in said electrical heating cartridge so as to be slidable lengthwise therein.

6. The improvement defined in claim 5 wherein said electrical heating cartridge has two of said electrical heating coils, said strands of said two of said electrical heating coils being positioned circumferentially staggered substantially 90° to each other.

* * * * *